United States Patent [19]

Henderson et al.

[11] Patent Number: 5,005,632

[45] Date of Patent: Apr. 9, 1991

[54] METHOD AND APPARATUS FOR COOLING A FLOW OF MOLTEN MATERIAL

[75] Inventors: Steven Henderson, Middlesbrough; Robert M. Perry, Egremont, both of England

[73] Assignee: British Steel Corporation, London, England

[21] Appl. No.: 418,980

[22] Filed: Oct. 10, 1989

Related U.S. Application Data

[63] Continuation of Ser. No. 296,352, Jan. 10, 1989, abandoned, which is a continuation of Ser. No. 90,681, filed as PCT GB86/00792 on Dec. 23, 1986, published as WO87/04098 on Jul. 16, 1987, abandoned.

[30] Foreign Application Priority Data

Dec. 30, 1985 [GB] United Kingdom ..... 8531837

[51] Int. Cl.[5] ..... B22D 1/00

[52] U.S. Cl. ..... 164/122; 164/133; 164/337; 164/900; 222/590; 222/592

[58] Field of Search ..... 164/418, 459, 465, 437, 164/438, 488, 489, 122, 133, 337, 900; 222/592, 590

[56] References Cited

U.S. PATENT DOCUMENTS

| | | | |
|---|---|---|---|
| 2,131,307 | 9/1938 | Behrendt | 164/418 |
| 3,559,720 | 2/1971 | Vogel et al. | 164/418 |
| 3,570,713 | 3/1971 | Tromel | 164/122 |
| 4,257,472 | 3/1981 | Tanner | 164/465 |
| 4,434,839 | 3/1984 | Vogel | 164/122 |
| 4,579,165 | 4/1986 | Kamei et al. | 164/418 |
| 4,580,616 | 4/1986 | Watts | 164/122 |
| 4,694,889 | 9/1987 | Spencely | 164/133 |

FOREIGN PATENT DOCUMENTS

| | | | |
|---|---|---|---|
| 554990 | 2/1960 | Belgium . | |
| 089196 | 9/1983 | European Pat. Off. . | |
| 1948886 | 4/1970 | Fed. Rep. of Germany . | |
| 1384334 | 2/1964 | France . | |
| 8207945 | 5/1982 | France . | |
| 792257 | 3/1958 | United Kingdom . | |
| 879437 | 10/1961 | United Kingdom | 164/418 |
| 1029543 | 5/1966 | United Kingdom . | |

*Primary Examiner*—Richard K. Seidel
*Attorney, Agent, or Firm*—Kinney & Lange

[57] ABSTRACT

A heat transfer conduit for extracting heat from a molten metal in transit from a containing vessel or delivery system includes at least two elongate segments separable along separation lines which lie generally in the direction of a longitudinal center line of the conduit, which in use, define a unitary structure. The segments can be disassembled following use for the removal of solidified material and other matter from the conduit interior.

17 Claims, 8 Drawing Sheets

METHOD AND APPARATUS FOR COOLING A FLOW OF MOLTEN MATERIAL

This is a continuation of application Ser. No. 07/296,352 filed on Jan. 10, 1989, abandoned as of the date of this application which was a continuation of application Ser. No. 90,681, filed Aug. 20, 1987 (now abandoned).

BACKGROUND OF THE INVENTION

1. Field of the Invention

This invention relates to apparatus for and a method of cooling a flow of molten material. More especially, the invention concerns the removal of heat from a flow of molten material, e.g. liquid metal, passing along or through a heat transfer conduit.

2. Description of the Prior Art

Heat transfer conduits in the form of hollow tubes or open-topped channels are known for removing heat from molten materials which are about to be cast. Conventionally, molten material to be cast is held at a temperature in excess of the liquidus temperature of the material in order to avoid premature solidification of the material within a transfer vessel before entry into a casting mould. As a result, the solidification process tends to relatively slow because of the significant amount of super heat and latent heat which has to be removed from the material in the casting process leading to relatively low throughput rates and consequent macro-segregation in the cast product.

Such a heat transfer conduit or carrier is disclosed in our United Kingdom patent 21117687B.

Known heat transfer conduits or carriers (hereinafter referred to simply as heat transfer conduits) are of tubular or channel-shaped construction and rely upon their mass or are cooled externally by water sprays, coolant jackets or fluidised beds to provide the required heat transfer. It is also known that by providing sufficient shear rate within a molten material most or all of its superheat and some of its latent heat can be extracted whilst still preserving a low viscosity within the molten material to achieve steady state heat removal without blockage of the conduit occuring.

When using a heat transfer conduit a shell of solidified material may form at the internal surface of the conduit, particularly so if the heat extraction rates are high. The formation of the shell can lead to certain problems which the present invention sets out to alleviate.

Typically, when a molten material is passed through a heat transfer conduit of high conductivity, the following sequence of events occurs:

(a) the liquid material solidifies as it comes into contact with the relatively cool internal surface of the conduit wall to form a solid shell, the equilibrium thickness and shape of which depends on the heat transfer conditions existing within the conduit, the condition of the molten material and the characteristics of the conduit;

(b) the thickness of the solidified shell increases to achieve an equilibrium temperature profile in which the radially outer surface temperature of the shell is considerably cooler than that extant at the radially inner surface of the shell. Thus, the shell tends to shrink and become separated from the conduit surface at various locations about its circumference;

(c) the heat transfer may ultimately be limited by the shell thickness and its resistance to heat transfer;

(d) the inner surface of the conduit increases in temperature and expands thereby promoting the formation of a gap between the opposed surfaces of the conduit and the shell.

Following use of known heat transfer conduits, a shell of solidified material remains within the conduit. The shell may be distorted thereby making it difficult to remove from the conduit. Hitherto, attempts to remove the shell from a hollow heat transfer conduit have resulted in damage to the conduit and/or ancillary equipment. It is preferable that the shell be removed prior to restarting the casting process since the presence of a solid shell at a relatively low temperature in a hollow conduit might result in blockage. The present invention sets out to provide a heat transfer conduit which overcomes the aforementioned problems and which also provides enhanced heat transfer characteristics between the conduit and molten material flowing therethrough.

SUMMARY OF THE INVENTION

According to the present invention in one aspect, there is provided a method of cooling a molten material in transit from a containing vessel and/or delivery system, the method including the steps of passing the molten metal through a heat transfer conduit comprising at least two separable segments, extracting heat from the material to form a shell of solidified material at or adjacent to the inner surface of the conduit, controlling the rate at which heat is extracted thereby to maintain a flow of molten material through the conduit, and subsequently separating the conduit segments to facilitate removal of the solidified shell.

According to the present invention in another aspect, there is provided apparatus for cooling molten materials including a heat transfer conduit comprising at least two separable segments, and means for releasably assembling the segments together to define a unitary conduit which can be disassembled for the removal of solidified material and other matter from the conduit interior. Preferably, the segments are releasably clamped together.

The conduit may achieve the required heat transfer by relying on its mass, external coolant sprays, coolant jackets or fluidised beds.

In cross-section, the conduit may define a closed figure or one which is open along its upper surface. In the former case, the heat transfer conduit may be circular, polygonal, square, curvilinear, eliptical or rectangular in cross-section.

In one arrangement, the conduit is open-topped and includes a readily removable thermally insulated lid which, in use of the conduit, lies above the molten material passing through the conduit or the solidified shell formed therein. A gas, for example argon, may be introduced into the conduit to fill the space below the lid to minimise or eliminate contamination of the material with air.

By way of example, for a heat transfer conduit of square cross-section, the conduit may, in use, be so disposed that the diagonals of the section lie in vertical and horizontal planes. Alternatively, such a heat transfer conduit may be inclined with its diagonals at any suitable angle.

The internal surface of the conduit may be provided with ridges to promote multi-point contact between the conduit and material contained within the conduit.

Thus, the internal surface of the conduit may be, for example, fluted or rippled longitudinally or transversely.

Fillers or fluxes whose conductivity is greater than air may be injected into spaces formed between the opposed surfaces of the conduit and a solidified material shell at suitable locations, for example locations coincident with mating faces of the conduit segments. Such fillers may be gaseous or may comprise low melting point solids such as tin or slag or hydrocarbons. High conductivity gases such as helium may be alternatively, or additionally, be injected into the spacing formed between the conduit and shell of solidified material through suitably positioned ports formed in the conduit.

In the case of a hydrocarbon filler or flux being employed, degradation and carbonation takes place from which gases evolve to enhance heat transfer. In addition, or alternatively, low melting point materials can be used to line the inner surface or positioned at the segment joints of the hollow conduit. As liquid metal enters the hollow conduit, the low melting point material melts to fill partially the shrinkage/expansion gap.

The conduit may include at least one detachable liner set in a groove formed in the internal surface of the conduit and standing proud therefrom. Alternatively the liner may be attached to the internal surface of the conduit by, for example gluing, welding or by suitable tapering of both members. The liner may be constructed from a highly conductive material which expands when subjected to high temperature to provide intimate contact with the conduit internal surface whilst the solid shell contracts to give intimate contact between shell and liner. The liner may or may not be disposable. The, or each, liner may be shaped or positioned to promote turbulence within liquid material initially passing through the conduit to promote lapping of the molten material as the solid shell is formed. A lapped shell may give a smaller than average shrinkage/expansion gap with more point contacts to the inner conduit walls to enhance heat removal. The sides of the, or each, liner may be tapered such that its radially inner cross-sectional dimension is smaller than its radially outer cross-section.

The internal surface of the conduit may be provided with integral protrusions to assist heat transfer from the molten material to the walls of the heat transfer conduit and to enhance turbulence within the molten material initially passing through the conduit. The, or each, protrusion may be a discrete member, or may extend circumferentially or helically around the inner circumference of the conduit; alternatively, a combination of such protrusions may be provided. The sides of the, or each, protrusion may be tapered inwardly away from the surface of the conduit.

The heat transfer conduit may be pre-heated prior to use to reduce the gap which might otherwise occur and to prevent moisture condensation within the conduit.

If moisture forms on the inner wall of the conduit an explosion may occur as molten material entering the conduit heat the water to form steam. Preheating may be used to minimise the effect of such a catastrophic process which may otherwise occur during transient conditions at start-up of the apparatus. In transient conditions, the shell may grow very quickly and cause premature blockage; however, under steady state conditions, stable shells will be formed which will allow passage of molten metal.

A heat transfer conduit made up of at least two segments may be constructed so that its inner cross sectional shape is not fixed by the segment joint faces. The construction of the heat transfer conduit may be such that relative movement can be effected between the segments from which the conduit is constructed to reduce or eliminate the gap formed between the solidified shell and the conduit during use. A compressible material may be located between the mating faces of the conduit segments such that the internal cross-section of the conduit may be reduced during use of compression of such material.

The internal cross-section of the conduit may be substantially uniform along the conduit length or may vary along such length. The conduit internal cross-section may taper from one end to the other. Alternatively, the internal cross-section may taper from each end inwardly to a point or region at which the cross-section is at a minimum. Any taper formed may be continuous or comprise descrete steps whose lengths and diametral change may vary to suit the casting requirements.

Each segment of any conduit may be constructed by the abutment of individual sections whose quantity and size are determined by the casting requirements. Each segment section may vary in its longitudinal and diametral dimensions so that, when assembled together, a stepped conduit whose "diameter" can vary along its length will be formed. Each section may have its own individual cooling so that the cooling from the conduit can be adjusted along discrete portions of its length and "diameter" or it can be linked into the overall conduit cooling.

The direction of travel of molten material through the heat transfer conduit may be generally horizontal, vertical or inclined at an angle to the horizontal. Further, the flow path of material through the conduit may follow a straight line, a curved line or a helix or a combination of such paths such that a turbulent flow exists to generate shear rates no less than 400/second within the material.

The external surface of the heat transfer conduit may be cooled by means of water sprays or fluidised beds or a coolant flow jacket. In each case, the extent of coolant applied to the conduit external surface may differ along the length of the conduit.

A water cooled mandrel, which may be tapered, may be positioned within the conduit to enhance heat removal from material flowing through the conduit.

In one arrangement, the heat transfer conduit is designed with a critical maximum length (L) to diameter (D) ratio; the diameter (D) is defined as the diameter of the largest circle which can be inscribed in the internal cross-section of the conduit For liquid steel with a bulk velocity of 0.5 meters/second, the maximum L/D ratio is approximately 50 for liquid steel input with approximately 30° C. superheat for a smooth water cooled circular conduit. There is a maximum L to D ratio allowable for a given set of conditions which can be determined by experiment or from a mathematical model or a combination of these. One criterion is that the Reynolds Number is in excess of 4000; a second criterion is that the shear rate at the interface between liquid passing through the conduit and the solidified shell is greater than 400/sec. The maximum allowable L to D ratio does, itself, depend on the mean bulk velocity of the liquid material, within the conduit and the effective internal diameter of the conduit and the heat transfer conditions at the shell/conduit interface. It can be seen from the following equation that the shear rate which is related to the shear stress (T) of the liquid steel is also strongly dependent on the mean bulk velocity ($\bar{v}$) for longitudinal flow $$T = \frac{f}{2}\rho\, v^2$$

where f is the friction factor at the solid/liquid interface and $\rho$ is the density of the liquid metal. For other types of induced flow the relationship may differ.

Preferably, the internal walls of the conduits are made of a material with high conductivity such as copper, steel or silicon carbide.

In use, when the molten material inlet temperature is low, it may be desirable to reduce the amount of heat being removed. This can be achieved by reducing the flow of cooling or by increasing the gap between the shell and the conduit. This increase in gap can be achieved by the relative movement of the individual segments away from each other. It is possible that the segments may be fully removed from the skull and a suitable coolant used to cool the shell directly.

In a casting plant individual casts will vary in their cooling requirements. Where only one conduit is in use the amount of cooling can be adjusted by adding an insulating layer onto the inner face of the conduit wall which, in use, will separate the shell from the conduit. The insulating layer may vary in thickness and composition to give the required cooling.

During normal operation, the molten material may enter and leave the heat transfer conduit through refractory lined members which may be straight or shaped to form, for example, elbows. The conduit may be separable from one or both refractory members such that pre-heating of the refractories can be achieved without pre-heating of the conduit walls. The refractories may be preheated independently of any thermal treatment applied to the conduit walls. The refractory members may be mounted in such a manner that they can quickly be assembled to a heat transfer conduit with minimal loss of refractory pre-heating. The refractories may be shaped to include a spigot which enters the conduit so as to act as a thermal barrier to protect the entry and exit edges of the conduit bore. The bore of the inlet refractory can be shaped to impart to the material, as it enters the conduit, a tangential or spiral flow to enhance the shear rate within the conduit.

Magnetic flux generating equipment capable of magnetohydrodynamic forces within material flowing through the conduit may be provided to improve heat removal from such material and to increase the shear rate within the molten material. Means may additionally be provided to heat the conduit walls to promote melting of all or part of the solidified material shell. This can also be used to pre-heat the conduit prior to casting. The conduit used may be made from a refractory material such as silicon carbide.

The amount of heat being removed by the conduit can be varied by dynamically varying the flow rate of the coolant prior to its arrival at the conduit. Where the conduit comprises a water jacket, the flow rate can be adjusted by dynamically varying the dimensions of the cooling slot or slots.

The effluent from the conduit may be discharged into a conventional casting machine or into the nip of a pair of rolls which continuously form a solidified or partially solidified strand.

Means may also be provided to vibrate the conduit at any frequency, including ultrasonic frequencies, sufficient to improve the cooling characteristics of the conduit and to improve the cooling characteristics of the conduit and to increase shear rate within the molten material or to reduce the shell growth.

BRIEF DESCRIPTION OF THE DRAWINGS

The invention will now be described by way of example with reference to the accompanying diagrammatic drawings in which.

DETAILED DESCRIPTION OF THE DRAWINGS

Figure 1:
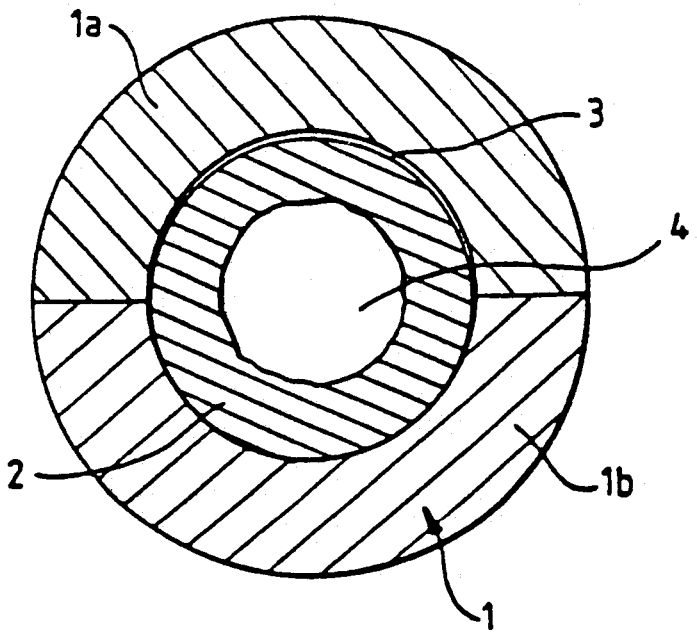
FIGS. 1 to 4 are transverse sections taken through heat transfer conduits in accordance with the invention.

The heat transfer conduit 1 illustrated in FIG. 1 is circular in cross-section and comprises two elongate semi-circular segments 1*a*, 1*b*. In use, molten metal passing through the central passageway 4 of the conduit 1 freezes to form a solid shell 2 against the internal surface of the conduit. The conduit 1 generally expands during use whilst the shell 2 gradually contracts to form a gap 3. Single line or point contact will occur as the shell moves downwardly under gravity. The gap 3 is, therefore, at its greatest at a location 180° radially from the line of contact.

Figure 2:
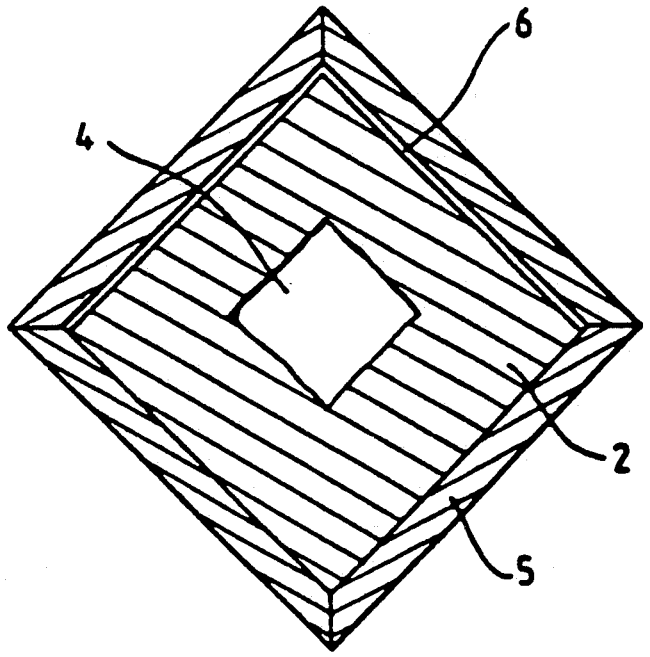

A square section heat transfer conduit 5 comprising four longitudinal segments is illustrated in FIG. 2. The individual segments are disposed such that the diagonals of the section lie generally in vertical and horizontal planes; gravity causes the solid shell 2 produced as molten material freezes within the conduit to contact the internal wall of the conduit over approximately 50% of its perimeter; the remaining wall perimeter is separated from the shell 2 by a gap 6.

Figure 3:
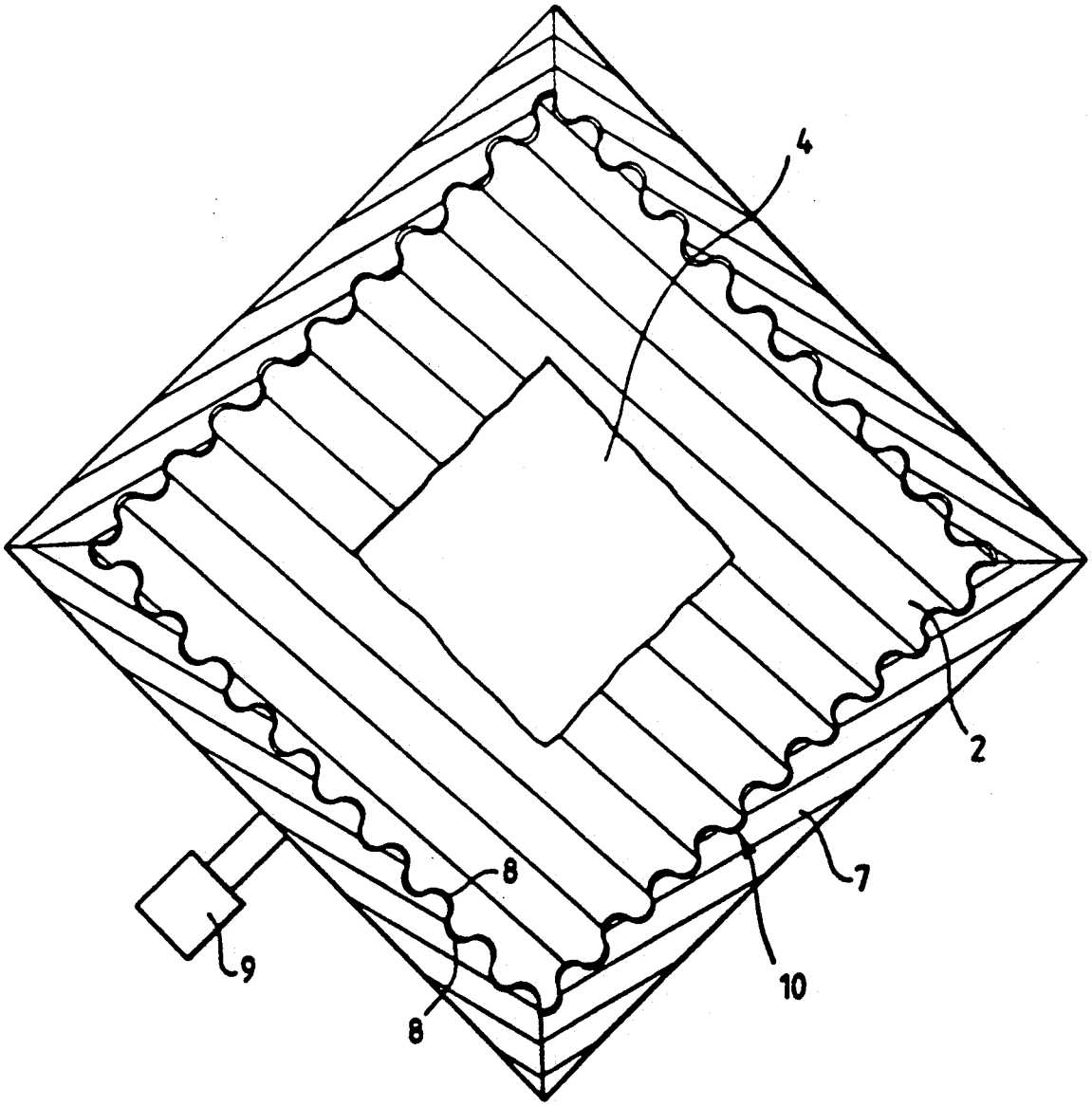

The transfer conduit 7 illustrated in FIG. 3 is similar to that of FIG. 2 but includes a series of longitudinally extending ridges 10. By means of the ridges, contact is achieved with the shell 2 at a plurality of contact lines and where the molten material is liquid steel and the conduit 7 is made from copper, approximately 0.8% expansion/contraction displacement between the shell and conduit occurs, this being illustrated in FIG. 3, with the shell and the conduit being co-axial. The peaks and troughs of the ridges 10 are separated from the shell 2 by gaps 8.

A vibration inducing device 9 in contact with the conduit 7 is provided to vibrate the conduit at a given frequency (which might be ultrasonic) to improve the cooling characteristics of the conduit and to increase shear rate within the molten material flowing therethrough or to reduce shell growth.

Figure 4:
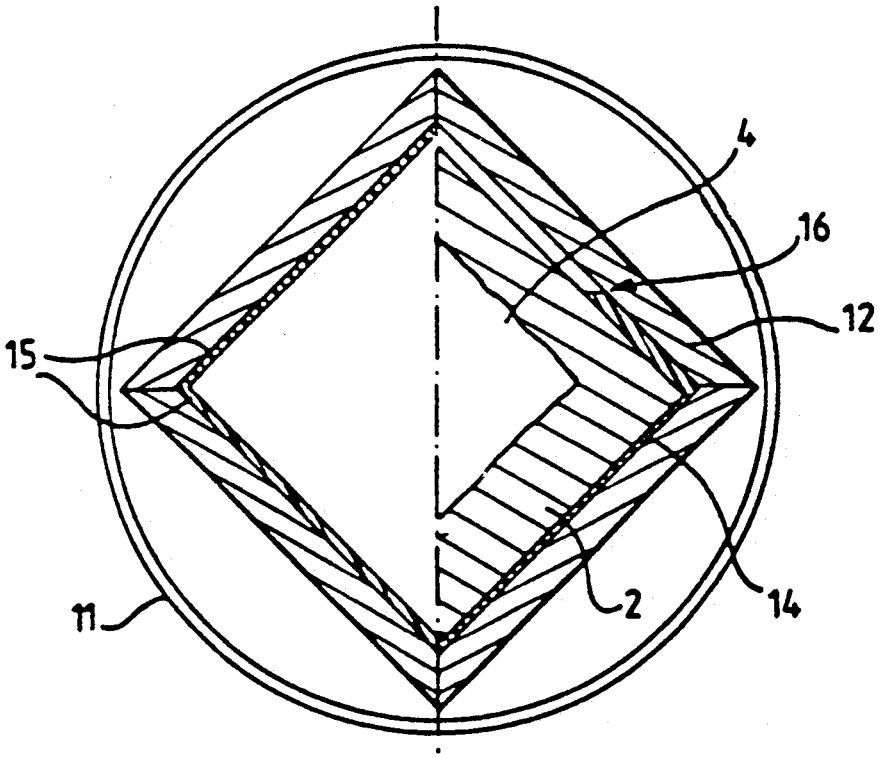

FIG. 4 illustrates, on its left hand side, a square section heat transfer conduit 12 before use, and on its right hand side, the conduit when in use. As will be seen from this Figure, prior to start-up the internal surface of the conduit 12 is lined with a low melting point filler or flux 15. As the process commences, the solid shell 2 is quickly formed. The filler or flux lining then melts, as indicated by reference numeral 14, to fill partially the shrinkage/expansion gap up to a level indicated by reference numeral 16. If the low melting point filler or flux is injected into the shrinkage/expansion gap formed between the shell 2 and conduit 12, then the whole of this gap can be filled by the injected high conductivity filler or flux.

If helium gas is used to replace air in the shrinkage/expansion gap, heat transfer characteristics are enhanced. A magnetic flux generator in the form of one or more electric coils 11 is located about the circumference of the conduit 12. The magnetic flux generated by the coils creates magnetohydrodynamic forces within the material flowing through the conduit to improve heat removal therefrom and to increase the shear rate within the molten material.

Figure 5:
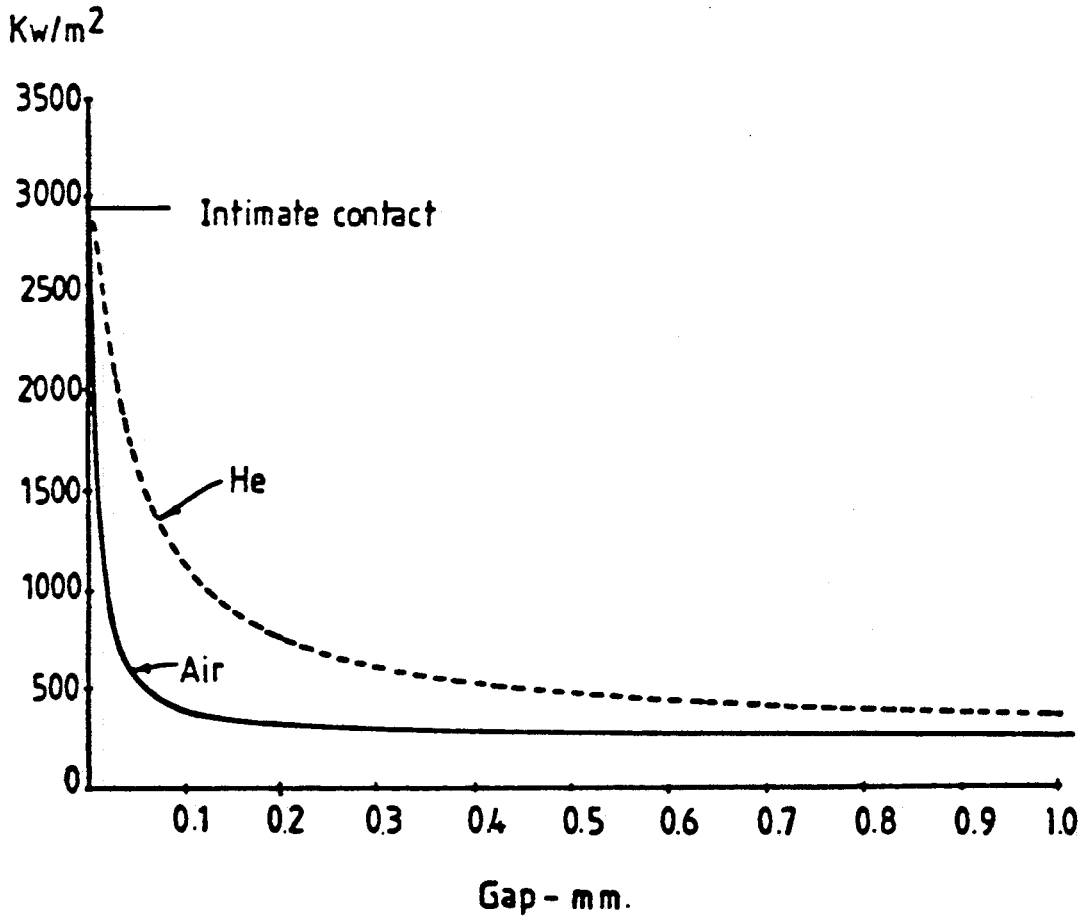
FIG. 5 graphically illustrates the relationship existing between heat flux existing across an air gap as a function of gap size and the same function for a gap filled with helium.

FIG. 5 illustrates this graphically by comparing the heat flux achieved across a given gap if the void is filled with stagnant air or with stagnant helium when the solid steel shell thickness is 10 mm and the water cooled conduit is made from copper.

Figure 6:
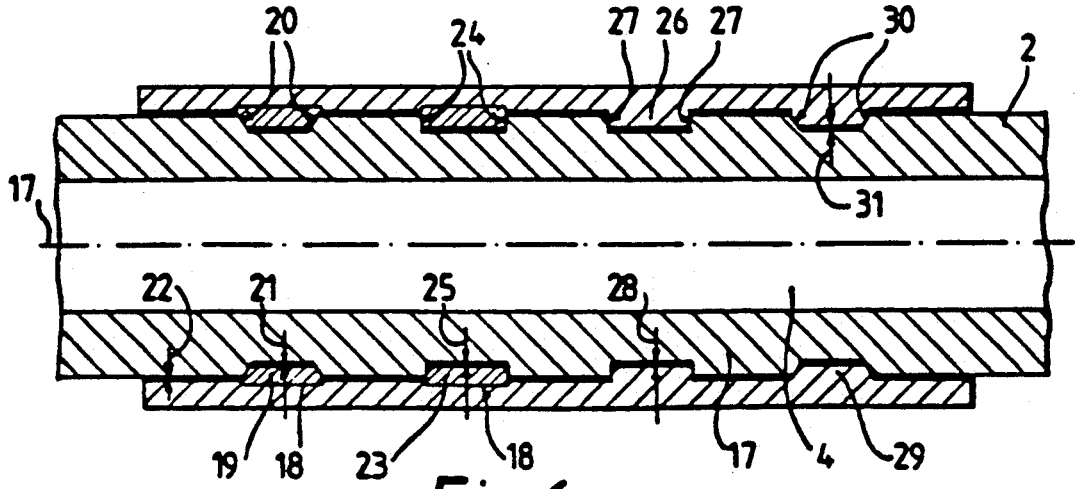
FIG. 6 is a longitudinal section taken through a further heat transfer conduit in accordance with the invention.

The heat transfer conduit illustrated in FIG. 6 includes a tapered liner 19, a rectangular liner 23, a rectangular protrusion 26 and a tapered protrusion 29. The longitudinal cross-section of the tapered liner 19 is such that its radial faces taper towards the axis of material flow 17. The liner 19 is set into a groove 18 which forms part of the conduit. Intimate contact between the shell 2 and the tapered liner 19 is achieved along the tapered faces 20 due to the tapered liner expanding longitudinally. At the same time, the shell 2 contracts longitudinally locally to eliminate the shrinkage/expansion gap to give the improved heat transfer characteristic typically illustrated in FIG. 5. Radial shrinkage/expansion gaps remain between the shell 2 and the conduit at a location indicated by reference numeral 22, and between the inner face of the tapered liner 19 and shell 2 at a location indicated by reference numeral 21. Intimate contact between the liner 19 and groove 18 will occur as a result of the liner 19, whose temperature is greater than the conduit body, radially expanding to take up any clearance.

The rectangular section liner 23 acts in a similar manner to the tapered liner 19, with intimate contact achieved along the radial faces 24. The heat removed through a rectangular section liner will be less than that through a tapered liner 19 set in the same size groove 18 because the length of shrinkage/expansion gap 25 associated with the inner face of the rectangular section liner 23 will be greater in length than the gap 21 associated with the tapered liner 19, whilst the length of radial faces 24 is less than faces 20 when in intimate contact with the shell 2.

Following use, any liner used within a segmented conduit in accordance with the invention can be reclaimed or disposed of with the shell.

The rectangular protrusions 26 also achieve intimate contact with the shell 2 along their radial faces 27 during operation of the process through longitudinal expansion and contraction of the shell. Radial shrinkage/expansion gaps remain between the shell 2 and conduit (as at 22) and between the inner face of the rectangular protrusion 26 and shell 22 (as at 28).

Tapered protrusions 29 act in a similar manner to the rectangular protrusions 26 with intimate contact achieved along radial faces 30. The longitudinal cross-section of each tapered protrusion 29 is such that its radial faces taper towards the axis of material flow 17. The heat removed through a rectangular protrusion will be less than that through a tapered protrusion whose axial length at the conduit wall is greater than the gap 31 associated with the tapered protrusion 29, whilst the length of the radial faces 27 is less than that of the faces 30 when in intimate contact with the shell 2. Tapered protrusions 29 are advantageous in that the shell 2 can be more readily removed from a conduit with tapered protrusions rather than rectangular protrusions.

In general, protrusions enjoy benefits over liner in that the heat transfer through a homogeneous solid is superior to that achieved between two solids in intimate contact.

Any protrusion or liner positioned within a conduit will promote turbulence within the molten material at start-up thereby causing lapping to occur. Lapping of the solid shell will give a greater number of point or line contacts and hence improve heat removal.

Any protrusion or liner may be segmented for ease of separation from the shell following use of the conduit.

Figure 7:
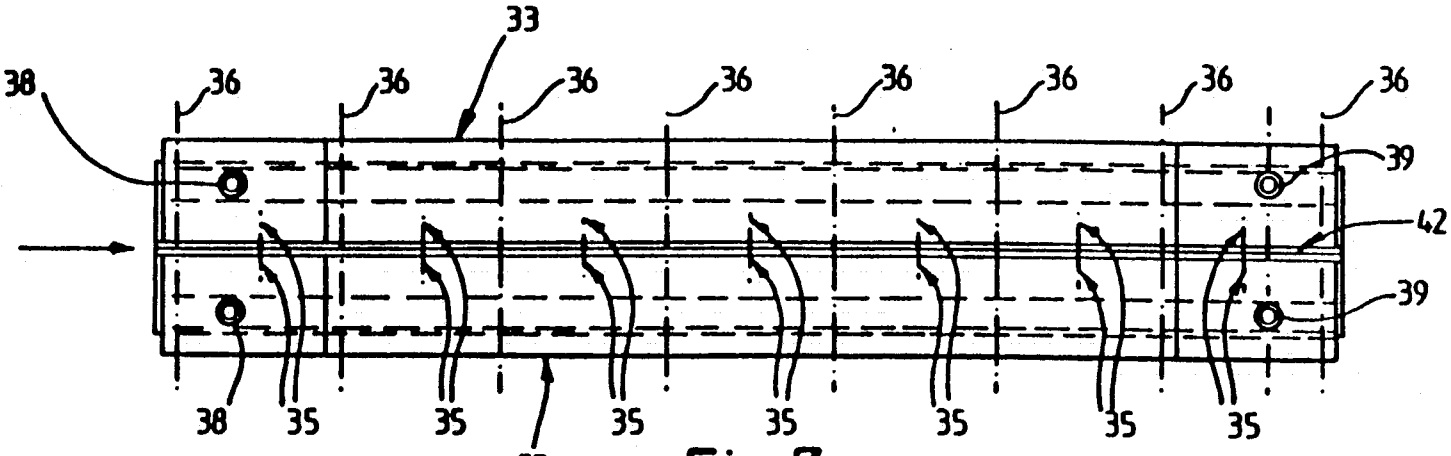
FIG. 7 is a side view of an alternative heat transfer conduit in accordance with the invention.
Figure 8:
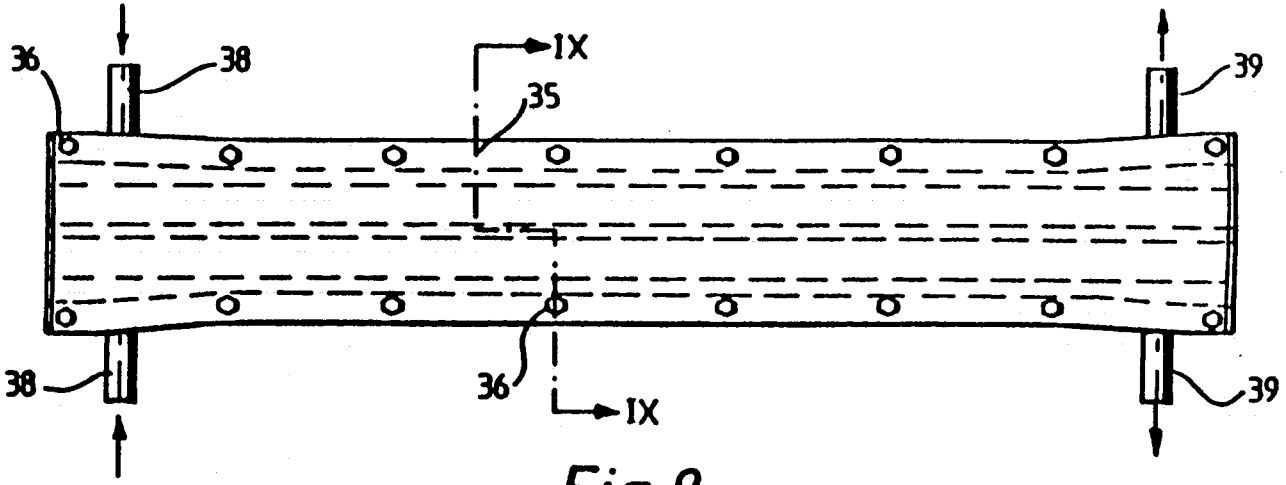
FIG. 8 is a plan view of the heat transfer conduit illustrated in FIG. 7.
Figure 9:
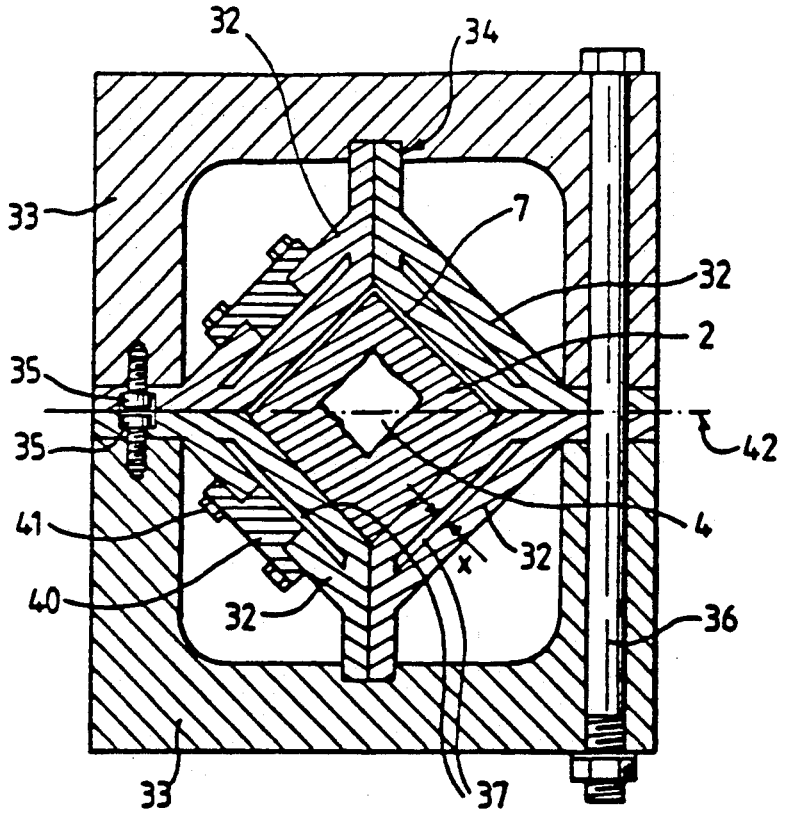
FIG. 9 is a section taken along line IX—IX of FIG. 8.

A further square section heat transfer conduit is illustrated in FIGS. 7 to 9. The conduit is formed by joining together four similar segments 32 into two backing frames 33. Two of the segments 32 are mounted into each backing frame 33 by bolts 35 located along the length of the conduit to form one half of the conduit. The complete heat transfer conduit is formed by bolting the backing frames 33, together with bolts 36. The segments 32 are sited in longitudinal slots 34, located in each backing frame 33 to minimise the formation of stresses arising from differential longitudinal expansion. Such stresses are further minimised by incorporating longitudinal slots in each segment 32 for bolts 36 and slots for bolts 35.

Each segment 32 incorporates a cooling slot 37 sized to give the required heat removal rate at a specific coolant velocity. The velocity of the coolant may vary along the length of each segment 32 by suitably varying the width and/or more especially thickness "x" of the coolant slot 37. The coolant, which may be water, enters the coolant slot 37 via pipes 38 and leaves by pipes 39. The coolant may enter from either end of the segments 32 but preferably from the same end as the molten material 4. Each segment 32 incorporates at least one cover 40 fixed by bolts 41 for inspecting the coolant slot 37 for contamination with dirt etc.

Following use of the conduit, the solid shell 2, which may be hollow, will remain. The shell 2 can readily be extracted by splitting the heat transfer conduit along its horizontal axis 42 after removing bolts 36 followed by the half carrier formed by one backing frame 33 together with the respective two segments 32. The process will not be affected by any distortion of the shell 2.

Figure 10:
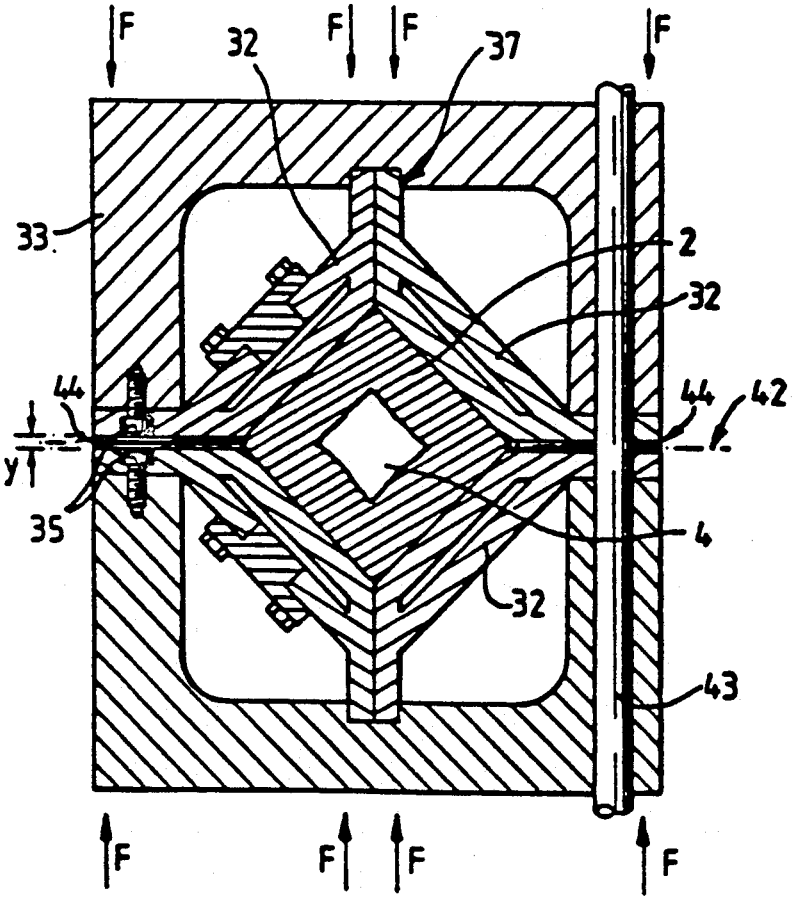
FIGS. 10 and 11 are cross-sections taken through alternative square section heat transfer conduits in accordance with the invention.

The shell 2 is formed in the conduit with a shrinkage/expansion gap 7 around the upper half of the conduit. The amount of heat removed can be increased by eliminating the shrinkage/expansion gap 7. The shrinkage/expansion gap 7 can be eliminated by adapting the equipment as illustrated in FIG. 10. The bolts 36 are replaced by guides 43 about which each half carrier assembly can move towards or away from the horizontal axis 42. A compressible layer or gasket 44 formed from a heat resistant compressible material (e.g. silica fibres) is placed between the joint faces of the segments such that the two half conduit assemblies are in a predetermined position to give a joint face separation of 'y'. A solid shell and shrinkage/expansion gap will form shortly after start-up of the process. A force F will then be exerted on one or both half conduit assemblies and cause the assemblies to close together until the entire shrinkage/expansion gap is taken up and an intimate contact with the shell 2 is achieved. This force F will remain for the full period of use of the conduit. The force F may be exerted by springs, pneumatically, hydraulically or electro-mechanically or another suitable means to achieve closure of the half carrier assemblies.

Figure 11:
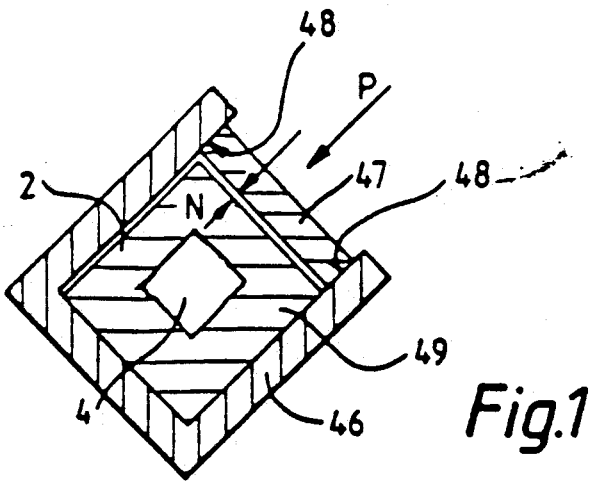

FIG. 11 illustrates a two piece heat transfer conduit constructed from a channel 46 and moving plate 47, with the moving plate 47 held in a fixed position prior to starting the process. Once the shell 2 has formed, a force P is exerted on the plate 47 which moves inwards guided by sliding faces 48 until dimension 'z' has been taken up, i.e. intimate contact between the moving plate 47 and shell 2 has been achieved. The force P can be exerted in a similar manner to force F previously described with reference to FIG. 10.

Figure 12:
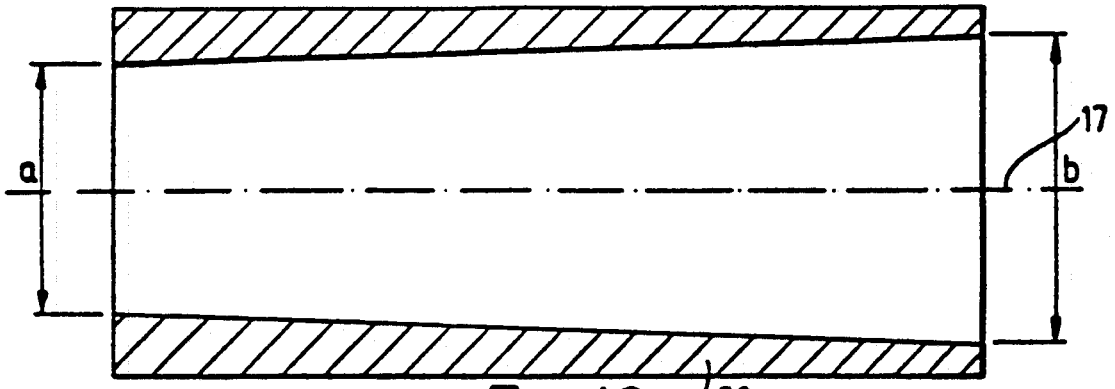
FIGS. 12 to 16 are longitudinal sections taken through still further heat transfer conduits in accordance with the invention.

FIG. 12 illustrates a tapered heat transfer conduit 50 having an axis of material flow 17 and in which the inner dimension linearly tapers from inlet to outlet, i.e. $a<b$ or $1>b$. This form of conduit may aid removal of a shell and will be beneficial to heat removal by moving the conduit in the direction of the axis of material flow 17 towards the solid shell formed within the conduit in use to give intimate contact.

Figure 13:
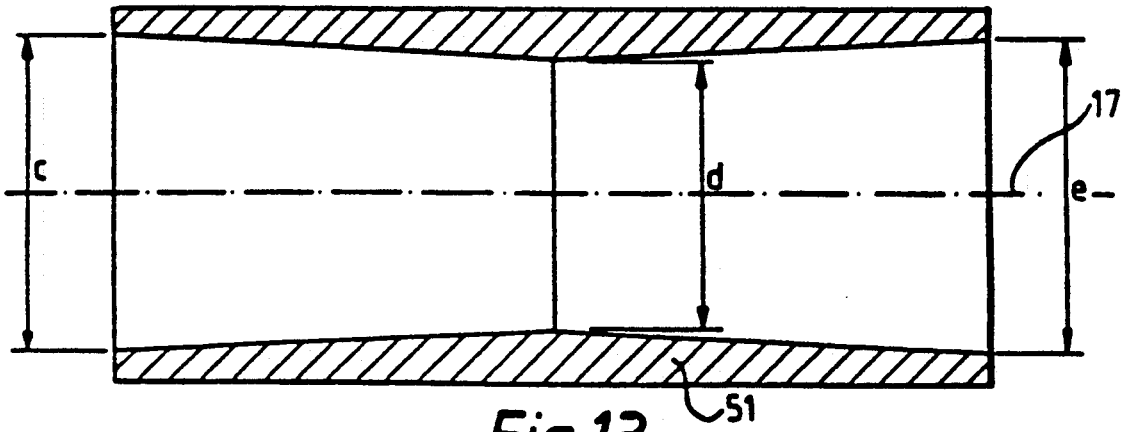

A double tapered conduit 51 is shown in FIG. 13 in which the following dimensional relationships can be used:

$$d < e \,\&\, c \qquad c = e \qquad \text{(i)}$$
$$d < e \,\&\, c \qquad c < e \qquad \text{(ii)}$$
$$d < e \,\&\, c \qquad c > e \qquad \text{(iii)}$$

Molten material may enter the conduit from either end.

This form of conduit is beneficial to heat removal. As the process approaches steady state conditions, the shell formed within the conduit contracts radially whilst the conduit itself expands radially to give a shrinkage/expansion gap as described previously. Simultaneously, the conduit expands along the axis of material flow as the shell contracts along the same axis; thus, a reduction in the shrinkage/expansion gap is achieved to improve heat removal. A double tapered hollow carrier as described incorporates readily separable segments as described previously in order that the shell within the conduit at the end of the process can be removed, i.e. the shell cannot be withdrawn along the axis of material flow as the minor diametral dimension is between the conduit ends.

Figure 14:
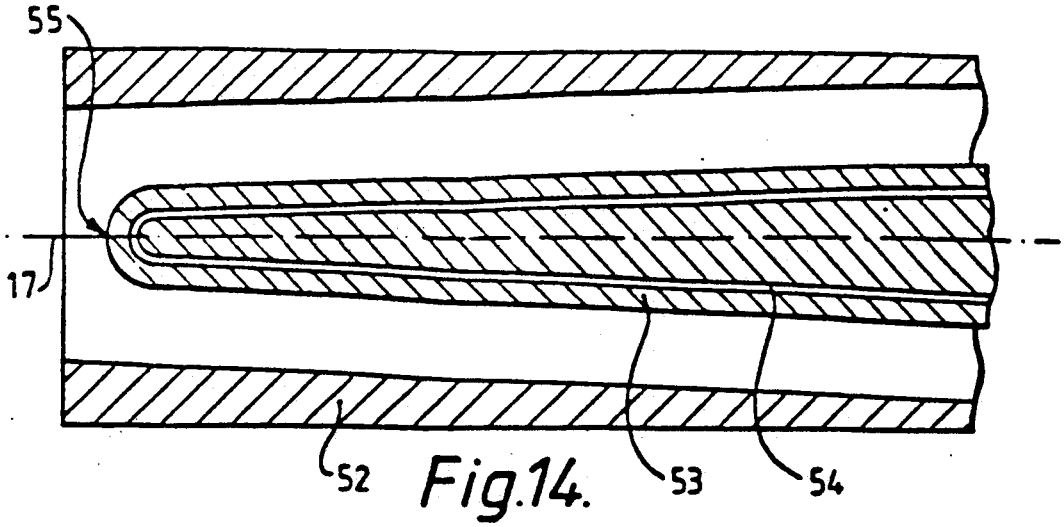

A heat transfer conduit 52 which incorporates a male mandrel 53 is shown in FIG. 14. The hollow conduit 52 is externally cooled whilst the male mandrel 53 is cooled internally by incorporating channels 54 through which coolant flows. This arrangement provides improved heat removal characteristics. This improvement is achieved as a result of the shell contracting diametrically whilst the mandrel 53 similarly expands giving intimate contact therebetween. The conduit 52 and mandrel 53 may alternatively each be parallel sided or each may be tapered along the axis of material flow 17. In each case, the area available for material flow should be substantially constant along the length of the conduit.

Preferably, the conduit 2 and mandrel 53 are both tapered to aid shell removal at the conclusion of the process. The mandrel 53 can be positioned such that the material flows towards or away from the mandrel end 55.

Figure 15:
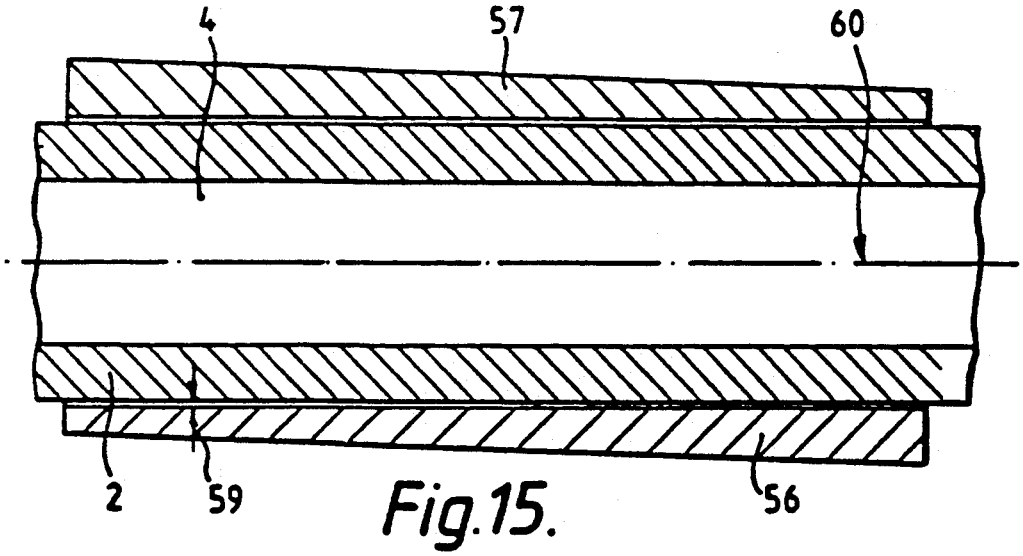
Figure 16:
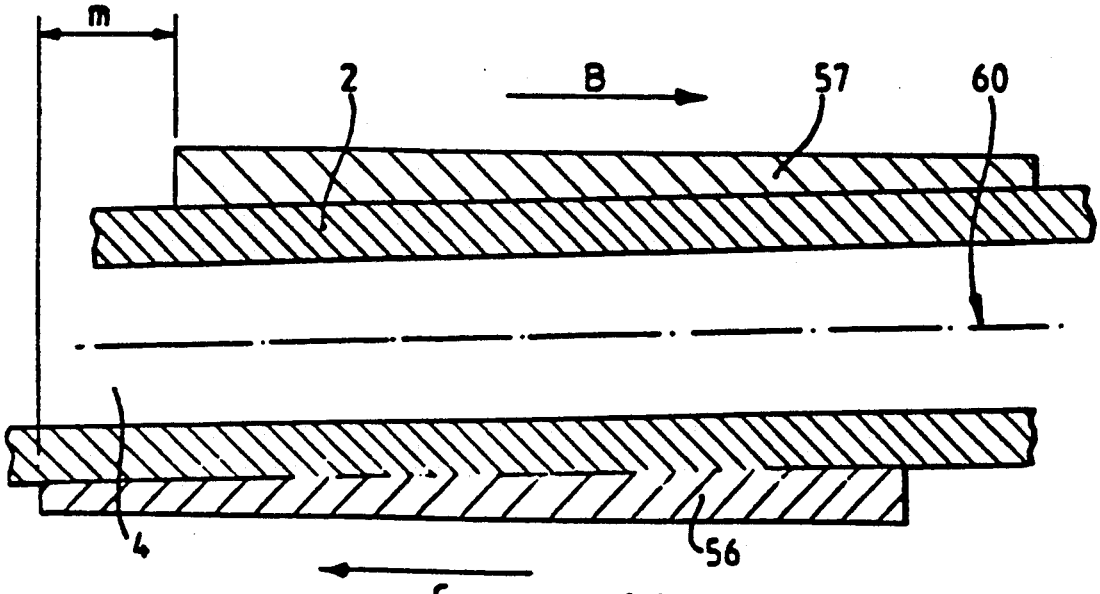

FIGS. 15 and 16 illustrate a split heat transfer conduit of two tapered half segments 56 and 57 mounted such that the tapers form a parallel sided conduit in which the bore of the conduit is also the axis of material flow 60.

In use, a hollow shell 2 through which molten material flows is formed within the conduit, the half tapered segments 56 and 57 of which are arranged with their ends in line (see FIG. 15). A shrinkage/expansion gap 59 is formed. The two tapered half segments 56 and 57 are moved in opposite directions, i.e. tapered half segment 57 is moved in the direction of arrow B whilst tapered half segment 56 is moved in the direction of arrow C. The tapered half segments 56 and 57 are moved independently until intimate contact is achieved for both tapered half segments 56 and 57, i.e. total movement is equal to dimension 'm' to give an improvement to the heat removal.

Figure 17:
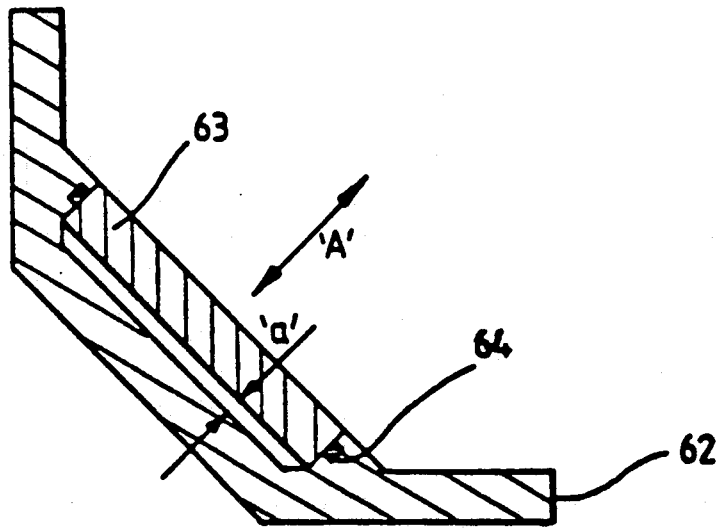
FIG. 17 is a section taken through a conduit segment alternative to those illustrated in FIGS. 9 and 10.

FIG. 17 shows an alternative conduit segment to those shown in FIGS. 9 and 10. This conduit segment incorporates a moving plate 63 and a fixed plate 62. The moving plate 63 is movable in the directions shown by arrow 'A' to increase or decrease the dimension 'a' and hence increase or decrease the rate of heat removal. A seat 64 is placed around the joint faces between the moving plate 63 and the fixed plate 62.

The length of any particular conduit can be adjusted by adding further sections to the end. This will make it possible to have a conduit of variable length to suit varying conditions from one use to another.

In summary, the invention described sets out to alleviate physical and heat transfer problems due to shell formation within a segmented heat transfer conduit by a combination of one, or more, or all of the above mentioned features.

We claim:

1. An open-ended tubular heat transfer conduit for conveying molten material from a first station to a second station and for controllably extracting heat from the molten material as it passes in a molten state through the conduit from the first station to the second station, the tubular conduit including means for promoting turbulent flow conditions within molten material passing therethrough to generate within the molten material shear rates sufficient to maintain fluidity of the molten material emerging from the conduit, and the tubular heat transfer conduit being constructed from at least two elongate segments separable along separation lines which lie generally in the direction of a longitudinal center line of the conduit and generally in a direction normal to the longitudinal center line, each segment defining one of at least two side wall sections of the tubular conduit, the at least two side wall sections being releasably assembled together to define the open-ended tubular heat transfer conduit, and the at least two side wall sections being selectively disassembled prior to re-use to provide access to the conduit interior for the removal of solidification material and other matter from an interior of the conduit.

2. A heat transfer conduit as claimed in claim 1 wherein the heat transfer conduit is shaped and dimensioned to promote turbulent flow which generates shear rates in the material passing through the conduit in excess of 400/second.

3. A heat transfer conduit as claimed in claim 1 wherein an internal surface of the conduit is formed with a plurality of longitudinally extending corrugations to promote contact between the conduit and material passing therethrough.

4. A heat transfer conduit as claimed in claim 1 wherein the conduit further comprises a lining having a thermal conductivity higher than that of air, the lining being present at locations at which, in use of the conduit, separation between solidified molten material and the conduit internal surface occurs.

5. A heat transfer conduit as claimed in claim 1 wherein the conduit further includes at least one detachable liner which lies in contact with an internal surface of the conduit and stands proud therefrom.

6. A heat transfer conduit as claimed in claim 1 wherein an internal cross-section of the conduit varies along the length of the conduit.

7. A heat transfer conduit as claimed in claim 1 wherein the separate segments, when assembled, form a hollow conduit which is curvi-linear or multi-sided in cross-section, each segment including means for controlling the rate at which heat is transferred between the segment and material flowing through the conduit.

8. A heat transfer conduit as claimed in claim 1 wherein at least one conduit segment is movable in a direction towards and away from the longitudinal center line of the conduit.

9. A heat transfer conduit as claimed in claim 1 wherein the internal surface of the heat transfer conduit is at least partially lined with an insulating material.

10. A heat transfer conduit as claimed in claim 9 wherein the internal surface of the conduit is lined with a refractory material.

11. A heat transfer conduit as claimed in claim 9 wherein the internal surface of the conduit is lined with a consumable material.

12. A heat transfer conduit as claimed in claim 1 further comprising magnetic flux generating means operable to create magnetohydrodynamic forces within material flowing through the conduit.

13. A heat transfer conduit as claimed in claim 1 wherein the conduit comprises at least two tapered segments, at least one of which is movable relative to the other in the longitudinal direction of the conduit.

14. A heat transfer conduit as claimed in claim 1 wherein at least one segment comprises a plurality of longitudinal sections.

15. A method of cooling molten material as it passes in a molten state from a first end to a second end of a heat transfer conduit within which it is subjected to turbulent flow conditions and sufficient shear rate to maintain its fluidity, the method comprising the steps of assembling together at least two elongate separable conduit segments separable along separation lines which lie generally in the direction of a longitudinal center line of the conduit and generally in a direction normal to the longitudinal center line to define a unitary conduit, extracting heat in a controlled manner from the molten material while in transit from the first end to the second end of the conduit to form a shell of solidified material adjacent to an inner surface of the conduit, and, after use, separating the conduit segments to facilitate the removal of the solidified shell from within the conduit interior.

16. The method as claimed in claim 15 wherein the shear rates generated in the material passing through the conduit are in excess of 400/sec.

17. A heat transfer conduit for conveying molten material from a first station to a second station and for controllably extracting heat from the material as it passes through the conduit, the conduit including means for promoting turbulent flow conditions within molten material passing therethrough to generate within the molten material shear rates sufficient to maintain fluidity of the molten material emerging from the conduit, and the heat transfer conduit being constructed from at least two elongate separate segments separable along separation lines which lie generally in the direction of a longitudinal center line of the conduit and generally in a direction normal to the longitudinal center line which are releasably assembled together to define a unitary conduit which can selectively be disassembled prior to reuse for the removal of solidified material and other matter from an interior of the conduit; wherein an elongate mandrel is positioned within the conduit interior with a longitudinal axis of the mandrel generally coincident with a longitudinal axis of the conduit, means being provided to convey a coolant medium along lengthwise extending passageways formed in the mandrel.

* * * * *